US010529467B2

(12) United States Patent
Aoyagi et al.

(10) Patent No.: US 10,529,467 B2
(45) Date of Patent: Jan. 7, 2020

(54) COAXIAL CABLE

(71) Applicant: TATSUTA ELECTRIC WIRE & CABLE CO., LTD., Osaka (JP)

(72) Inventors: Yoshihiko Aoyagi, Kyoto (JP); Yoshinori Kawakami, Osaka (JP); Kiyotaka Urashita, Kyoto (JP)

(73) Assignee: TATSUTA ELECTRIC WIRE & CABLE CO., LTD., Osaka (JP)

( * ) Notice: Subject to any disclaimer, the term of this patent is extended or adjusted under 35 U.S.C. 154(b) by 0 days.

(21) Appl. No.: 16/089,207

(22) PCT Filed: Dec. 20, 2016

(86) PCT No.: PCT/JP2016/005186
§ 371 (c)(1),
(2) Date: Sep. 27, 2018

(87) PCT Pub. No.: WO2017/168481
PCT Pub. Date: Oct. 5, 2017

(65) Prior Publication Data

US 2019/0108930 A1 Apr. 11, 2019

(30) Foreign Application Priority Data

Mar. 31, 2016 (JP) ..... 2016-072005

(51) Int. Cl.
*H01B 7/00* (2006.01)
*H01B 11/18* (2006.01)
(Continued)

(52) U.S. Cl.
CPC ..... *H01B 11/1834* (2013.01); *H01B 3/441* (2013.01); *H01B 13/016* (2013.01)

(58) Field of Classification Search
CPC . H01B 3/02; H01B 3/441; H01B 7/02; H01B 11/1834; H01B 13/016
(Continued)

(56) References Cited

U.S. PATENT DOCUMENTS 3,315,025 A * 4/1967 Tomlinson ..... H01B 7/0233 156/54
3,529,340 A * 9/1970 Brorein ..... H01B 11/1839 174/110 F
(Continued)

FOREIGN PATENT DOCUMENTS

| | | |
|---|---|---|
| JP | 56-123413 | 9/1981 |
| JP | 2011-034906 | 2/2011 |
| JP | 2011-228146 | 11/2011 |

OTHER PUBLICATIONS

International Search Report dated Feb. 14, 2017 filed in PCT/JP2016/005186.

*Primary Examiner* — William H. Mayo, III
(74) *Attorney, Agent, or Firm* — Rankin, Hill & Clark LLP

(57) ABSTRACT

A coaxial cable is configured so that adhesion between an insulating layer and a shield layer can be improved without addition of an adhesive component and roughening of an adhesive surface. The coaxial cable includes a center conductor, the insulating layer covering the outer periphery of the center conductor, the shield layer covering the outer periphery of the insulating layer, and a sheath covering the outer periphery of the shield layer. An anchor layer containing resin whose glass-transition point is equal to or lower than 15° C. is provided between the insulating layer and the shield layer.

5 Claims, 1 Drawing Sheet

(51) Int. Cl.
*H01B 3/44* (2006.01)
*H01B 13/016* (2006.01)

(58) Field of Classification Search
USPC ..... 174/102 R, 103, 105, 106 R, 108
See application file for complete search history.

(56) References Cited

U.S. PATENT DOCUMENTS 4,173,669 A * 11/1979 Ashida ..... C03C 17/32
428/34.7
4,296,019 A * 10/1981 Nelson ..... C08J 3/091
524/390
4,484,023 A * 11/1984 Gindrup ..... C09J 123/08
156/332
5,926,949 A * 7/1999 Moe ..... H01B 11/1808
156/54
9,899,553 B2 * 2/2018 Akasaki ..... H01L 31/0481

* cited by examiner

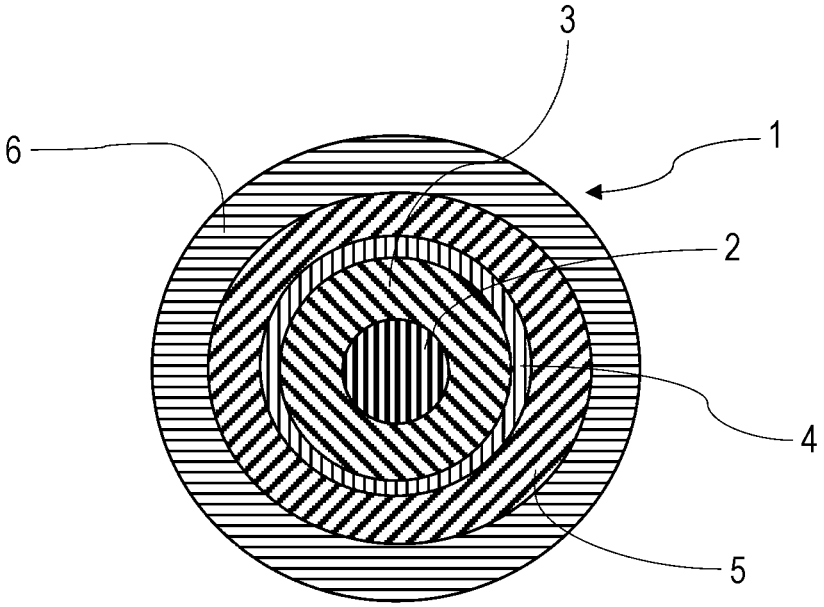
3
6
1
2
4
5

COAXIAL CABLE

TECHNICAL FIELD

The present invention relates to a coaxial cable.

BACKGROUND ART

Conventionally, a coaxial cable configured such that an insulating layer and a shield layer are provided at the outer periphery of a center conductor has been broadly used for electronic equipment such as a mobile phone and medical equipment. Generally, the shield layer is formed from a braid or a tape wrapping. However, there is a problem that productivity is low due to an extremely-low linear velocity at the step of forming these components.

In recent years, further diameter reduction in a coaxial cable has been demanded with an increasing demand for size reduction and weight reduction in electronic equipment and medical equipment. For diameter reduction in the coaxial cable, thickness reduction in a shield layer is effective. However, there is a problem that a finished outer diameter is great in the method for forming the shield layer from a braid or a metal tape wrapping.

For this reason, the method for forming a shield layer by use of, e.g., conductive paste has been used. In the case of using the conductive paste, the shield layer is formed in such a manner that a conductor covered by an insulating layer passes through a tank filled with the conductive paste to apply the conductive paste to an insulating layer surface, and then, is squeezed in a die and dried. In this case, there might be a problem that the insulating layer is detached from the shield layer during the subsequent step of forming a sheath layer. Improvement of adhesive properties between the insulating layer and the shield layer remains as an issue.

For example, a method in which an adhesive component is mixed with conductive paste is conceivable as a solution to this problem. Moreover, a method in which a surface of an insulating layer is roughened has been also known (see Patent Literatures 1 and 2).

CITATION LIST

Patent Literature

PATENT LITERATURE 1: JP-A-2011-34906
PATENT LITERATURE 2: JP-A-2011-228146

SUMMARY OF THE INVENTION

Problems to be Solved by the Invention

However, in the method in which the adhesive component is mixed with the conductive paste, it is difficult to form a uniform layer due to, e.g., agglomeration of other components of the conductive paste.

Moreover, the method in which the surface of the insulating layer is roughened does not fulfill a market demand due to a problem such as signal instability.

The present invention has been made in view of the above-described points. An object of the present invention is to provide a coaxial cable configured so that adhesion between an insulating layer and a shield layer is improved without addition of an adhesive component and roughening of an adhesive surface.

Solution to the Problems

For solving the above-described problems, the coaxial cable according to the present invention includes a center conductor, an insulating layer covering the outer periphery of the center conductor, a shield layer covering the outer periphery of the insulating layer, and a sheath covering the outer periphery of the shield layer. An anchor layer containing resin whose glass-transition point is equal to or lower than 15° C. is provided between the insulating layer and the shield layer.

The anchor layer may contain olefin-based resin.

The thickness of the anchor layer may be 0.5 μm to 10 μm.

BRIEF DESCRIPTION OF THE DRAWINGS

FIG. 1 is a sectional view of a coaxial cable according to an embodiment of the present invention.

DESCRIPTION OF THE EMBODIMENTS

Hereinafter, an embodiment of the present invention will be more specifically described with reference to the drawings.

A coaxial cable 1 according to the present embodiment has a center conductor 2, an insulating layer 3 covering the outer periphery of the center conductor 2, a shield layer 5 covering the outer periphery of the insulating layer 3, and a sheath 6 covering the outer periphery of the shield layer 5. The coaxial cable 1 has, between the insulating layer 3 and the shield layer 5, an anchor layer 4 containing resin whose glass-transition point is equal to or lower than 15° C.

As long as a material of the center conductor 2 allows transmission of an electric signal, such a material is not specifically limited. For example, a metal material such as copper or copper alloy, a copper wire having a surface plated with metal, or a copper alloy wire having a surface plated with metal and containing copper and other metals can be used as the center conductor 2. Tin plating, silver plating, and other types of metal plating can be used as metal plating.

The center conductor 2 may include a single conductor, or may be configured such that multiple conductors are twisted together. The center conductor 2 preferably includes one to seven conductors.

Although not specifically limited, the diameter of the center conductor 2 is preferably 10 μm to 100 μm, and more preferably 15 μm to 50 μm.

Resin used for the insulating layer 3 is not specifically limited. Such resin includes, for example, modified-polyphenyleneether resin (hereinafter referred to as "m-PPE"), olefin-based resin, polyester-based resin, and vinyl chloride-based resin. Examples of the olefin-based resin include polyethylene-based resin, polypropylene-based resin, and cycloolefin-based resin. Examples of the polyester-based resin include polyethylene terephthalate-based resin and polybutylene terephthalate-based resin. Among these materials, the olefin-based resin and m-PPE are preferable, considering excellent dielectric properties. Among the olefin-based resins, the cycloolefin-based resin is more preferable.

Although not specifically limited, the thickness of the insulating layer 3 is preferably 15 μm to 100 μm.

As long as resin used for the anchor layer 4 is resin whose glass-transition point is equal to or lower than 15° C., such resin is not specifically limited. The resin is preferably olefin-based resin or styrene-based resin. These resins may be used alone, or two or more types of resin may be used in combination.

In the present specification, the glass-transition point is the following temperature. That is, in a differential scanning calorimeter (e.g., a product name "DSC 220 Type" manufactured by Seiko Instruments Inc.), a measurement sample of 5 mg is put into an aluminum pan, and the aluminum pan is sealed with a lid being pressed. After the sample has been completely melted with 220° C. being maintained for 5 minutes, the sample is rapidly cooled by liquid nitrogen. Thereafter, measurement is performed with a temperature increase rate of 20° C./minute from −150° C. to 250° C., and a temperature at an inflection point of the resultant curve is taken as the glass-transition point.

The olefin-based resin usable for the anchor layer includes not only homopolymer of an olefin-based compound, but also copolymer of two or more types of olefin-based compounds and copolymer of an olefin-based compound and other compounds. The olefin-based compound includes, for example, ethylene, propylene, 1-butene, 2-butene, 1-hexene, 2-hexene, and butadiene. Other compounds include styrene-based compounds, for example.

Regarding the type of resin, resin with a higher percentage in terms of mass ratio among building blocks is taken as a reference. For example, for resin containing ethylene and propylene as building blocks, in a case where the ethylene has a higher percentage in terms of mass ratio, this resin is referred to as "polyethylene-based resin." In a case where the propylene has a higher percentage, this resin is referred to as "polypropylene-based resin." For resin containing propylene and butadiene as building blocks, in a case where the propylene has a higher percentage in terms of mass ratio, this resin is referred to as "polypropylene-based resin." In a case where the butadiene has a higher percentage, this resin is referred to as "polybutadiene-based resin." For resin containing an olefin-based compound and a styrene-based compound as building blocks, in a case where the olefin-based compound has a higher percentage in terms of mass ratio, this resin is referred to as "olefin-based resin." In a case where the styrene-based compound has a higher percentage, this resin is referred to as "styrene-based resin."

These resins may be modified. For example, maleic anhydride-modified polypropylene and copolymer of maleic anhydride-modified polypropylene and other olefin-based resins can be used as these resins.

These resins may be random copolymer or block copolymer. For example, block copolymer of styrene and butadiene can be used as these resins.

Among the above-described resins, the polypropylene-based resin, the polybutadiene-based resin, and the styrene-based resin are more preferable, and the maleic anhydride-modified polypropylene and the block copolymer of styrene and butadiene are much more preferable.

Examples of the resin whose glass-transition point is equal to or lower than 15° C. include a product name "TC4010" sold by Unitika Ltd. Note that the glass-transition point is measured by the above-described measurement method.

Although not specifically limited, the thickness of the anchor layer 4 is preferably 0.5 μm to 10 μm, and more preferably 1 μm to 5 μm. The thickness of the anchor layer 4 is equal to or greater than 0.5 μm, and therefore, excellent adhesive properties between the insulating layer 3 and the shield layer 5 are exhibited. The thickness of the anchor layer 4 is equal to or less than 10 μm, and therefore, the resin can be evenly applied for formation of the anchor layer 4.

Although not specifically limited, the following method can be used as the method for forming the anchor layer 4. That is, the resin whose glass-transition point is equal to or lower than 15° C. is dispersed or melted in a dispersion medium (including a solvent), and in this manner, a resin composition for the anchor layer is produced. The resin composition is applied to the insulating layer 3, and then, is dried.

Although not specifically limited, the dispersion medium used for the resin composition for the anchor layer includes water and an organic solvent, for example. The organic solvent includes, for example, toluene, acetone, ethyl methyl ketone, hexane, and alcohol. Among these solvents, the water and the alcohol are preferable, considering avoidance of deterioration of the insulating layer 3.

Although not specifically limited, the content (the total amount in a case where two or more types are used in combination) of the resin whose glass-transition point is equal to or lower than 15° C. in the resin composition for the anchor layer is preferably 10 to 50% by mass.

The resin whose glass-transition point is equal to or lower than 15° C. is used for the anchor layer 4, so that adhesion between the insulating layer 3 and the shield layer 5 can be improved. Such a mechanism is not known, but is assumed as follows. That is, the glass-transition point of the resin of the anchor layer 4 is equal to or lower than 15° C., and therefore, the resin of the anchor layer 4 may be easily deformed to fill a fine recessed-raised portion of an insulating layer surface are allowed when the resin of the anchor layer 4 is, at normal temperature (15 to 25° C.), applied to a wire (the center conductor) provided with the insulating layer 3. Thus, the anchor layer 4 can firmly adhere to the insulating layer 3. Thereafter, at a drying step, the solvent is volatilized under environment of 80 to 120° C., and the anchor layer 4 is solidified. In this manner, an anchor layer-equipped wire is obtained. Conductive paste is, at the normal temperature, applied to the resultant anchor layer-equipped wire. Thereafter, at a drying step, the anchor layer-equipped wire is placed under environment of 100 to 200° C., and then, is cooled to the normal temperature. In association with such a temperature change, the volumes of the insulating layer 3 and the shield layer 5 change. That is, these layers thermally expand upon drying, and contract upon cooling to the normal temperature. Since the glass-transition point of the resin of the anchor layer 4 is equal to or lower than 15° C., the anchor layer 4 is in a soft state during a volume change. Thus, the anchor layer 4 can follow a change in the volumes of the insulating layer 3 and the shield layer 5, and therefore, adhesion force can be ensured.

Conductive paste can be used for formation of the shield layer 5. Although not specifically limited, paste containing metal and a dispersion medium can be used as the conductive paste.

The metal may be metal particles or a metal organic compound. Although not specifically limited, the types of metal include gold, silver, copper, aluminum, nickel, and alloy thereof. These metals may be used alone, or two or more types of metal may be used in combination.

Although not specifically limited, the average particle size of the metal particles is preferably 10 nm to 20 μm. Although not specifically limited, the average particle size of the metal organic compound is preferably 1 to 20 μm. In the present specification, the average particle size means a particle size as an average particle size D50 (a median size) measured based on the number by a laser diffraction scattering method. Note that the average particle size of powder of equal to or less than 100 nm means a particle size measured by a transmission electron microscope.

Although not specifically limited, the shape of the metal particle includes, for example, a spherical shape, a needle shape, a fiber shape, a flake shape, and a dendritic shape.

Generally, the metal organic compound means a compound with a carbon-metal bond. The metal organic compound includes, for example, a coordination compound (R (a hydrocarbon group)-S (sulfur)-Ag (silver)) by an amine process and organic acid metallic salt. The metal organic compound means such a compound that by drying in a temperature range of equal to or lower than 300° C., a metallic bond is generated to form a fine metal film (Ag).

Although not specifically limited, examples of the organic acid metallic salt include cyclohexane carboxylic acid metallic salt, formic acid metallic salt, cyclohexanepropionic acid metallic salt, acetic acid metallic salt, and oxalic acid metallic salt.

Although not specifically limited, the dispersion medium used for the conductive paste includes, for example, an organic solvent and water. The organic solvent includes, for example, toluene, acetone, ethyl methyl ketone, and hexane. These solvents may be used alone, or two or more types of solvents may be used in combination.

Although not specifically limited, the thickness of the shield layer is preferably 2 μm to 100 μm.

As long as resin used for the sheath 6 is resin exhibiting insulating properties, such resin is not specifically limited. Examples of such resin include thermoplastic resin, thermosetting resin, and ultraviolet curable resin.

The thermoplastic resin includes, for example, polyvinyl chloride (PVC), polyurethane, olefin-based resin, and fluorine-based resin.

The polyurethane is a collective term of polyurethane and polyurethane-urea. As long as the polyurethane is copolymer having a urethane bond, the polyurethane is not specifically limited. Note that the polyurethane may be obtained by reaction of an amine component, as necessary.

Examples of the olefin-based resin include the above-described polyethylene-based resin and the above-described polypropylene resin.

Examples of the fluorine-based resin include polytetrafluoroethylene resin (PTFE), tetrafluoroethylene-perfluoroalkylvinylether copolymer, ethylenetetrafluoro ethylene copolymer (ETFE), and fluoroethylene hexafluoropropylene copolymer (FEP).

Examples of the thermosetting resin include phenol resin, acrylic resin, epoxy resin, melamine resin, silicon resin, and acrylic-modified silicon resin.

Examples of the ultraviolet curable resin include epoxy acrylate resin, polyester acrylate resin, and a methacrylate-modified product thereof.

Note that a curing form is not specifically limited as long as curing is allowed. The curing form includes, for example, thermal curing and ultraviolet curing.

Although not specifically limited, the thickness of the sheath layer is preferably 1 μm to 100 μm, and more preferably 5 μm to 20 μm.

Although not specifically limited, the diameter of the coaxial cable 1 according to the present invention is preferably 60 μm to 200 μm.

Although not specifically limited, the following method can be, for example, used as the method for manufacturing the coaxial cable 1 according to the present invention. First, the resin to be the insulating layer 3 is extruded to a uniform predetermined thickness by an extruder. This resin covers the center conductor 2 to form the insulating layer 3, and in this manner, an insulating layer-equipped wire is produced. Next, the resultant insulating layer-equipped wire is set at a sender. The insulating layer-equipped wire is continuously sent out to pass through a tank filled with the resin composition for the anchor layer. Thereafter, the insulating layer-equipped wire is squeezed in a die, and is dried (a drying temperature: 80 to 120° C., a drying time: 10 minutes). In this manner, the anchor layer-equipped wire provided with the anchor layer 4 having a uniform predetermined thickness is produced. Thereafter, the anchor layer-equipped wire passes through a tank filled with the conductive paste. The anchor layer-equipped wire is squeezed in a die, and is dried (a drying temperature: 100 to 200° C., a drying time: 10 minutes). In this manner, a shield layer-equipped wire provided with the shield layer 5 having a uniform predetermined thickness is produced. The shield layer-equipped wire is wound around a bobbin. Thereafter, the shield layer-equipped wire is set at a sender. The shield layer-equipped wire is continuously sent out, and a sheath material is extruded onto the outer periphery of the shield layer-equipped wire by an extruder. The shield layer-equipped wire is covered by the sheath material such that a uniform predetermined thickness is provided. In this manner, the sheath 6 is formed. By winding around a drum, the coaxial cable 1 can be manufactured.

Not only the above-described method by dipping in the tank filled with the resin composition for the anchor layer but also a method by spraying by a spray can be also used as the method for applying the anchor layer 4 to the insulating layer 3, for example.

According to the present invention, the shield layer 5 is formed using the conductive paste. Thus, as compared to the case of forming the shield layer 5 by braiding of conductive fibers and the case of forming the shield layer 5 by winding of a metal tape, a linear velocity can be significantly increased, and film thickness reduction can be realized. Moreover, the anchor layer 4 can be formed by the steps only including application of the resin for the anchor layer to the insulating layer 3, squeezing in the die, and drying. Thus, multiple coaxial cables 1 can be simultaneously manufactured by an inexpensive simple facility without the need for significantly increasing working processes and a working time.

EXAMPLES

Hereinafter, examples of the present invention will be described. Note that the present invention is not limited by the following examples. Note that unless otherwise stated, a mixing ratio and the like described below are based on the mass.

Using resin shown in Table 1 below, an insulating layer-equipped wire was produced in such a manner that an insulating layer material including each component of Table 1 is extruded to the outer periphery of a center conductor by an extruder to form an insulating layer. The resultant insulating layer-equipped wire was dipped in a tank in which each component of Table 1 used for an anchor layer is dissolved in a solvent. Then, the resultant insulating layer-equipped wire was squeezed in a die, and was dried (a drying temperature: 80° C. to 120° C., a drying time: 10 minutes). In this manner, the anchor layer was formed. Thereafter, a shield layer-equipped wire was obtained by dipping in a tank of conductive paste including each component of Table 1, squeezing in a die, and drying (a drying temperature: 100° C. to 200° C., a drying time: 10 minutes).

Details of each component of Table 1 are as follows.

(Insulating Layer)

Modified-polyphenyleneether resin (m-PPE): "Flexible Noryl WCA871A" manufactured by SABIC (Anchor Layer)

Resin 1: maleic anhydride-modified polypropylene, glass-transition point=−33° C., "Arrow Base TC4010" manufactured by Unitika Ltd.

Resin 2: styrene-butadiene-based resin, glass-transition point=−39° C., "Nipol LX426" manufactured by Zeon Corporation Resin 3: maleic anhydride-modified polypropylene, glass-transition point=115° C., "Arrow Base DB4010" manufactured by Unitika Ltd.

Solvent: water (Shield Layer)

Conductive paste: type of metal particle=Ag, average particle size of metal particles=equal to or less than 100 nm, "KGKNano AGK101" manufactured by Kishu Giken Kogyo Co. Ltd.

For the resultant shield layer-equipped wire, adhesion between the insulating layer and the shield layer was evaluated. An evaluation method is as follows.

Adhesion: the prototype shield layer-equipped wire was, as a sample, fixed on a sample fixing film. An adhesive tape (Cellotape (registered trademark) CT-24 of Nichiban Co., Ltd, adhesive force: 4 N/10 mm) with a width of 24 mm was bonded to an upper surface of the sample across a length of 3 cm. Next, the adhesive tape was pulled at a speed of 10 cm/second in the direction of 90 degrees with respect to the surface of the sample, and in this manner, the adhesive tape was peeled off. In this state, the wire whose shield layer is peeled off from the insulating layer was evaluated as "poor (a cross mark)," and the wire whose shield layer is not peeled off at all was evaluated as "favorable (a white circle)."

TABLE 1

| | Insulating Layer | Anchor Layer | | | | Shield Layer | | |
|---|---|---|---|---|---|---|---|---|
| | Resin Type | | Resin Type | Glass-Transition Point | Thickness | Metal Particle (Type) | Metal Particle (Average Particle Size) | Adhesion |
| Example 1 | m-PPE | Resin 1 | Maleic Anhydride-Modified Polypropylene | −33° C. | 2 μm | Ag | 100 nm or less | ○ |
| Example 2 | m-PPE | Resin 2 | Styrene-Butadiene-Based Resin | −39° C. | 2 μm | Ag | 100 nm or less | ○ |
| Comparative Example 1 | m-PPE | Resin 3 | Maleic Anhydride-Modified Polypropylene | 115° C. | 2 μm | Ag | 100 nm or less | X |
| Comparative Example 2 | m-PPE | | None | — | 0 | Ag | 100 nm or less | X |

Results are as shown in Table 1. First and second examples using resin whose glass-transition point is equal to or lower than 15° C. exhibit better adhesion between the insulating layer and the shield layer as compared to a first comparative example using resin whose glass-transition point is higher than 15° C. Moreover, the first and second examples exhibit better adhesion between the insulating layer and the shield layer as compared to a second comparative example where no anchor layer was formed.

LIST OF REFERENCE NUMERALS

1 Coaxial cable
2 Center conductor
3 Insulating layer
4 Anchor layer
5 Shield layer
6 Sheath

The invention claimed is:

1. A coaxial cable comprising:

a center conductor;

an insulating layer covering an outer periphery of the center conductor;

a shield layer covering an outer periphery of the insulating layer; and a sheath covering an outer periphery of the shield layer, wherein an anchor layer containing resin whose glass-transition point is equal to or lower than 15° C. is provided between the insulating layer and the shield layer, the resin contained in the anchor layer is at least one selected from a group consisting of olefin-based resin, styrene-based resin and a combination of the olefin-based resin and the styrene-based resin, the olefin-based resin includes at least one selected from a group consisting of homopolymer of an olefin-based compound, copolymer of two or more types of the olefin-based compounds, and copolymer of the olefin-based compound and other compound, the olefin-based compound includes at least one selected from a group consisting of propylene, 1-butene, 2-butene, 1-hexene, 2-hexene and butadiene, and the other compound includes styrene-based compound.

2. The coaxial cable according to claim 1, wherein a thickness of the anchor layer is 0.5 μm to 10 μm.

3. The coaxial cable according to claim 1, wherein the resin contained in the anchor layer is at least one selected from a group consisting of maleic anhydride-modified polypropylene and copolymer of maleic anhydride-modified polypropylene and other olefin-based resins.

4. The coaxial cable according to claim 1, wherein the resin contained in the anchor layer is at least one selected from a group consisting of polypropylene-based resin, polybutadiene-based resin and styrene-based resin.

5. The coaxial cable according to claim 1, wherein the resin contained in the anchor layer is at least one selected from a group consisting of maleic anhydride-modified polypropylene and block copolymer of styrene and butadiene.

* * * * *